US007845978B1

(12) United States Patent
Chen

(10) Patent No.: US 7,845,978 B1
(45) Date of Patent: Dec. 7, 2010

(54) TOOL-FREE COAXIAL CONNECTOR

(75) Inventor: Han-Jung Chen, Taipei (TW)

(73) Assignee: Ezconn Corporation, Taipei (TW)

( * ) Notice: Subject to any disclaimer, the term of this patent is extended or adjusted under 35 U.S.C. 154(b) by 0 days.

(21) Appl. No.: 12/458,578

(22) Filed: Jul. 16, 2009

(51) Int. Cl.
*H01R 9/05* (2006.01)

(52) U.S. Cl. ..... 439/578

(58) Field of Classification Search ..... 439/578, 439/582, 585, 584

See application file for complete search history.

(56) References Cited

U.S. PATENT DOCUMENTS 5,997,350 A * 12/1999 Burris et al. ..... 439/585
6,042,422 A * 3/2000 Youtsey ..... 439/585
7,182,639 B2 * 2/2007 Burris ..... 439/584
2006/0172571 A1 * 8/2006 Montena ..... 439/91
2006/0194474 A1 * 8/2006 Montena ..... 439/578

* cited by examiner

*Primary Examiner*—T C Patel
*Assistant Examiner*—Phuong Nguyen
(74) *Attorney, Agent, or Firm*—Rosenberg, Klein & Lee

(57) ABSTRACT

A tool-free coaxial connector including an inner sleeve, an outer sleeve coaxially assembled to the inner sleeve, and a slide collar. An arrowhead-shaped section is formed on an outer circumference of a rear end of the inner sleeve. An annular groove is formed on an outer circumference of the outer sleeve near a rear end thereof. The slide collar is slidably connected to the outer sleeve. An inner flange is formed at one end of the slide collar. When the coaxial cable is inserted into the connector, the outer conductor and the sheath of the cable are clamped between the inner and outer sleeves. When pulling the slide collar to a predetermined position, the inner flange of the slide collar tightly binds the sheath of the cable to securely connect the slide collar to the cable.

6 Claims, 4 Drawing Sheets

TOOL-FREE COAXIAL CONNECTOR

FIELD OF THE INVENTION

The present invention relates to a tool-free coaxial connector for connecting a coaxial cable to a connector of an electronic device.

BACKGROUND OF THE INVENTION

A coaxial connector is well known in the technological field of coaxial cable transmission. Typically, an F-type coaxial connector is screwed to a mating interface connector, so that a coaxial cable connected to the F-type coaxial connector can be electrically connected to various kinds of electronic devices, such as a television set, a CB (citizen's band) radio, an FM (frequency modulation) radio, and other amateur wireless systems.

FIG. 1 shows a conventional coaxial connector including a connector main body 10. The connector main body 10 includes an outer sleeve 11, an inner sleeve 12 coaxially arranged in the outer sleeve 11, and a retaining member 13 disposed around the inner sleeve 12.

A free end of a coaxial cable can be inserted into the connector main body 10 such that a central conductor and an insulating spacer of the coaxial cable are received in the inner sleeve 12, while an outer conductor and a sheath of the coaxial cable are positioned between the inner sleeve 12 and the outer sleeve 11. A hexagonal compression tool is used to apply a compression force onto the outer sleeve 11 so as to tightly bind the outer sleeve 11 to the sheath of the cable.

The above-described manner of assembling the coaxial cable to the coaxial connector has some problems. First, the existent coaxial cables vary in dimension so that three different sizes of hexagonal compression tools are needed to securely apply sufficient compression force onto the outer sleeve 11. This leads to increased cost. Moreover, it is inconvenient for an operator to carry various compression tools. Second, with respect to a coaxial cable with high-percentage of outer conductor, when the coaxial cable is inserted into the connector main body 10, the outer conductor might become damaged. Also, the coaxial cable might be inserted into the connector main body 10 in an incorrect direction. In this case, the electric signal transmission performance may be deteriorated.

SUMMARY OF THE INVENTION

A primary object of the present invention is to provide a tool-free coaxial connector that can be tightly connected to various sizes of coaxial cables without using any installation tool.

To achieve the above and other objects, the tool-free coaxial connector of the present invention includes a connector main body and a slide collar. The connector main body has an inner sleeve and an outer sleeve coaxially assembled to the inner sleeve. When connecting the coaxial cable to the coaxial connector, a free end of the coaxial cable is inserted into the connector main body. After inserted, the central conductor and the insulating spacer of the cable are received in the inner sleeve, while the outer conductor and the sheath of the cable are positioned between the inner and outer sleeves. An arrowhead-shaped section is formed at a rear end of the inner sleeve. An annular groove is formed on an outer circumference of the outer sleeve near a rear end thereof.

The slide collar is slidably connected to the outer sleeve. A locating structure is disposed on an inner circumference of the slide collar. An inner flange is formed at a rear end of the slide collar. When the slide collar is axially moved along the outer sleeve, the locating structure of the slide collar will enter the annular groove of the outer sleeve to locate the slide collar thereon. At this time, the arrowhead-shaped section of the inner sleeve is enclosed in the inner flange of the slide collar, so that the sheath of the cable is tightly clamped between the inner flange and the arrowhead-shaped section. Under such circumstance, the slide collar is securely mechanically connected to the cable to keep the cable in the connector.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENT

Figure 1:
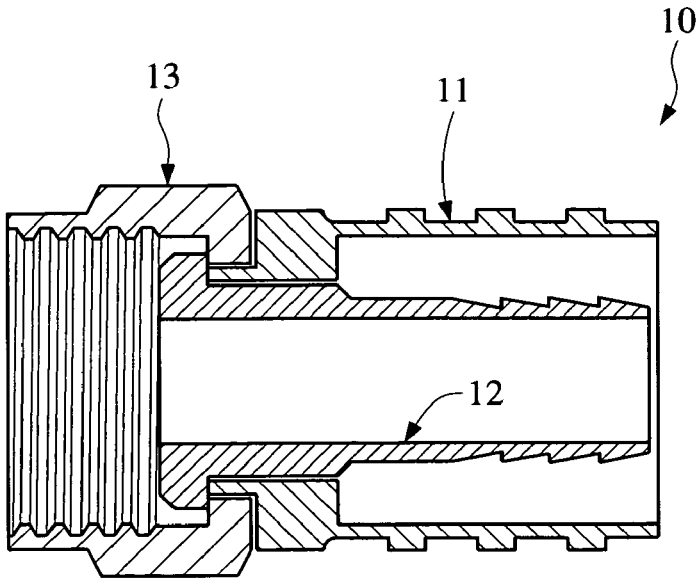
FIG.1 PRIOR ART
FIG. 1 is a sectional view of a conventional coaxial connector.
Figure 2:
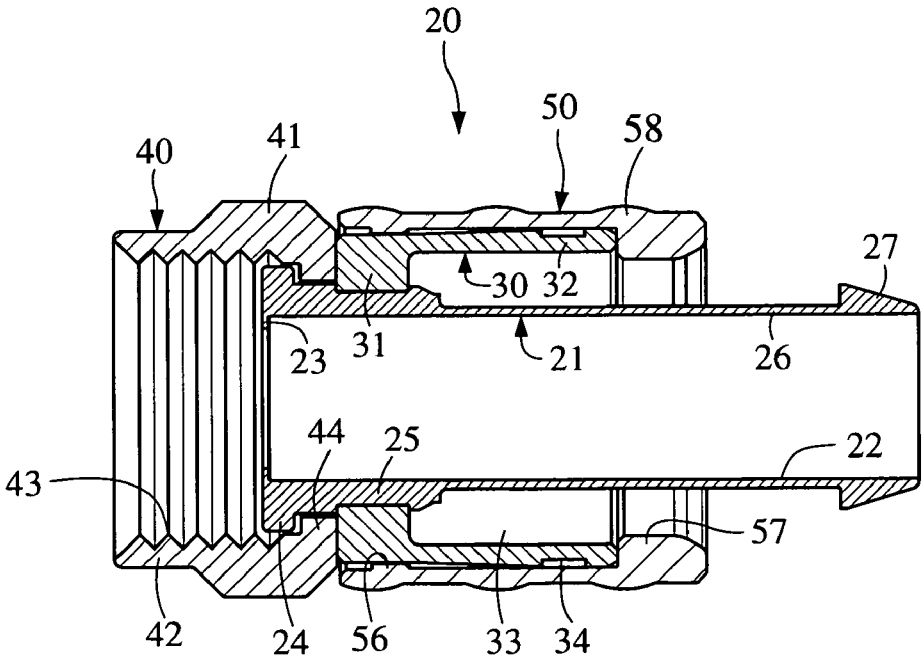
FIG. 2 is a sectional view of a preferred embodiment of the tool-free coaxial connector of the present invention.
Figure 3:
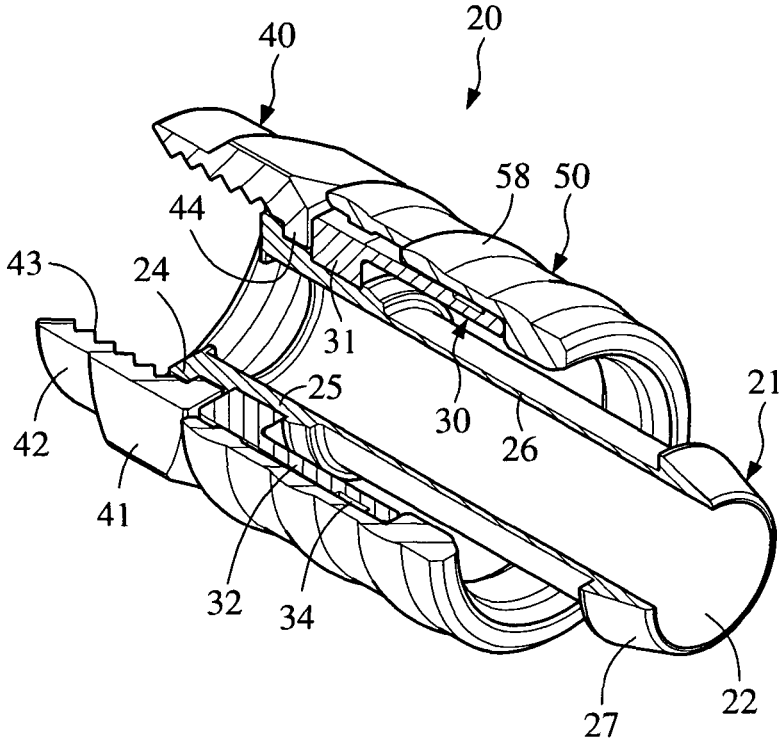
FIG. 3 is a perspective cutaway view of the tool-free coaxial connector of the present invention.
Figure 6A:
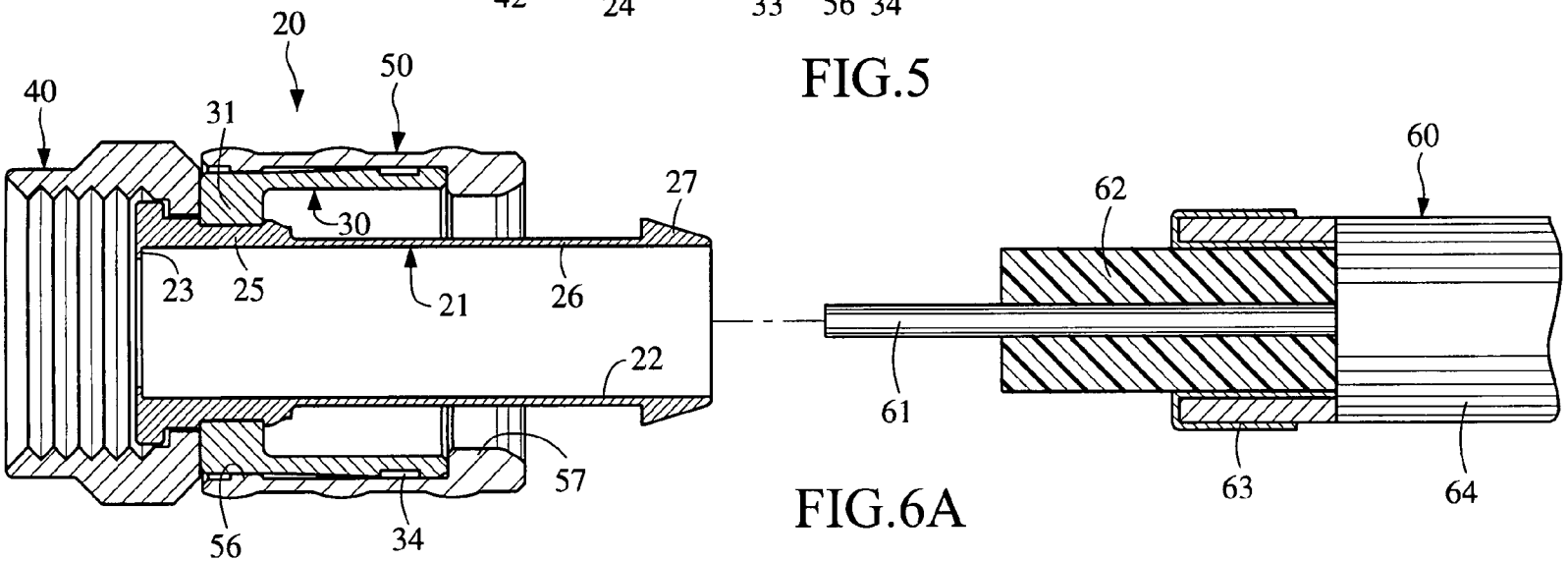
FIGS. 6A-6C are sectional views showing the installation of the tool-free coaxial connector of the present invention to a coaxial cable.

Please refer to FIGS. 2 and 3 and also to FIG. 6A, wherein FIG. 2 is a sectional view of the tool-free coaxial connector of the present invention and FIG. 3 is a perspective partially sectional view thereof. According to a preferred embodiment, the tool-free coaxial connector of the present invention includes a connector main body 20 and a slide collar 50. The connector main body 20 has an inner sleeve 21, an outer sleeve 30 and a retaining member 40.

The inner sleeve 21 defines a passage 22 for receiving a central conductor 61 and an insulating spacer 62 of a coaxial cable 60 (as shown in FIG. 6A). The passage 22 terminates at an inner flange 23 formed at a front end of the inner sleeve 21. The inner sleeve 21 further has an outer flange 24, an interface section 25 and a tubular protruding end section 26. The tubular protruding end section 26 has a free end. An arrowhead-shaped section 27 is formed on an outer circumference of the free end of the tubular protruding end section 26.

The outer sleeve 30 has an outer sleeve main body 31 fitted around the interface section 25 of the inner sleeve 21 and a rearward extending section 32. The rearward extending section 32 has a thickness smaller than that of the outer sleeve main body 31. The rearward extending section 32 is coaxially positioned around the tubular protruding end section 26 of the inner sleeve 21 to together define an annular space 33 for receiving an outer conductor 63 and a sheath 64 of the coaxial cable 60. An annular groove 34 is formed on an outer circumference of the rearward extending section 32 near a rear end thereof.

The retaining member 40 is positioned at a front end of the connector main body 20 and applicable to various connection interfaces, such as F-type, BNC-type, RCA-type and IEC-type connectors. In the illustrated embodiment, the retaining member 40 is used in an F-type connector. The retaining member 40 includes a hexagonal section 41 and an annular end section 42. The hexagonal section 41 has a threaded inner surface 43, which can be mechanically and electrically screwed to a certain device. The hexagonal section 41 has a rear end formed with an inward protruding section 44. The inward protruding section 44 is sandwiched between the outer flange 24 and the outer sleeve main body 31 and freely rotatable between the inner and outer sleeves 21, 30.

Figure 4:
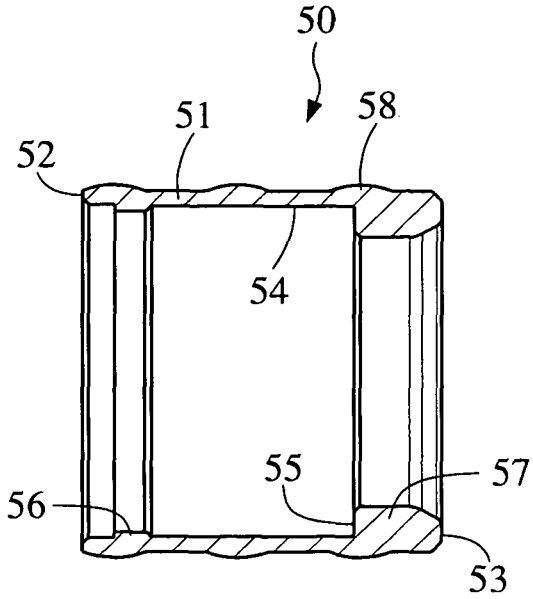
FIG. 4 is a sectional view of the slide collar of the tool-free coaxial connector of the present invention.
Figure 5:
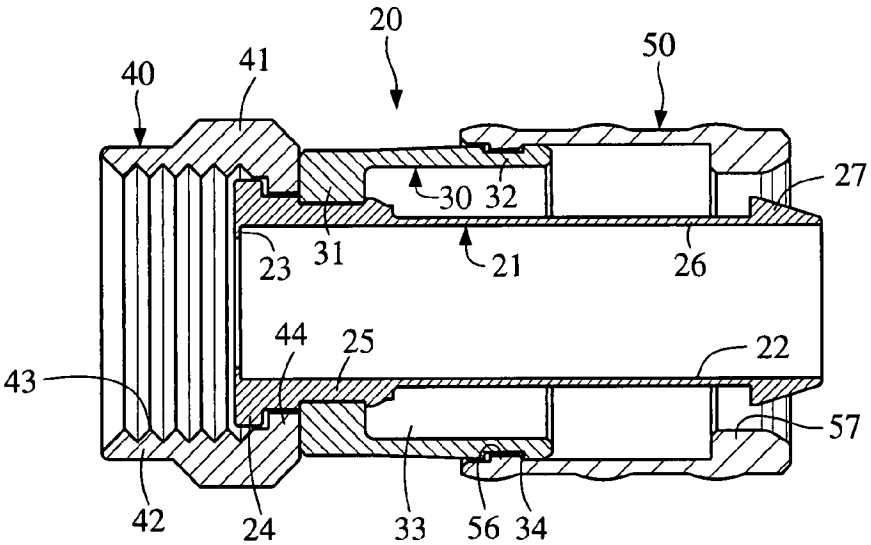
FIG. 5 is a sectional view according to FIG. 2, showing that the slide collar is pulled to a predetermined position.

Referring to FIG. 4, the slide collar 50 is slidably connected to the outer sleeve 30. The slide collar 50 includes a tubular main body 51 having a first end 52 and a second end 53. The tubular main body 51 defines a hole 54 terminating at a stepped thrust section 55. A locating structure 56, such as an annular rib 56 or a protrusion, is formed on an inner circumference of the first end 52 of the tubular main body 51. The annular rib 56 has a width smaller than that of the annular groove 34 of the outer sleeve 30. The second end 53 of the tubular main body 51 is formed with an inner flange 57. Annular protrusions 58 or other anti-slip structures are disposed on an outer circumference of the tubular main body 51 for avoiding slippage when manually pulling out the slide collar 50. When pulling the slide collar 50 to a predetermined position, the annular rib 56 of the slide collar 50 will snap into the annular groove 34 of the outer sleeve 30. Under such circumstance, the slide collar 50 is located on the outer sleeve 30 and the arrowhead-shaped section 27 of the inner sleeve 21 is enclosed in the inner flange 57 of the slide collar 50 as shown in FIG. 5.

Figure 6B:
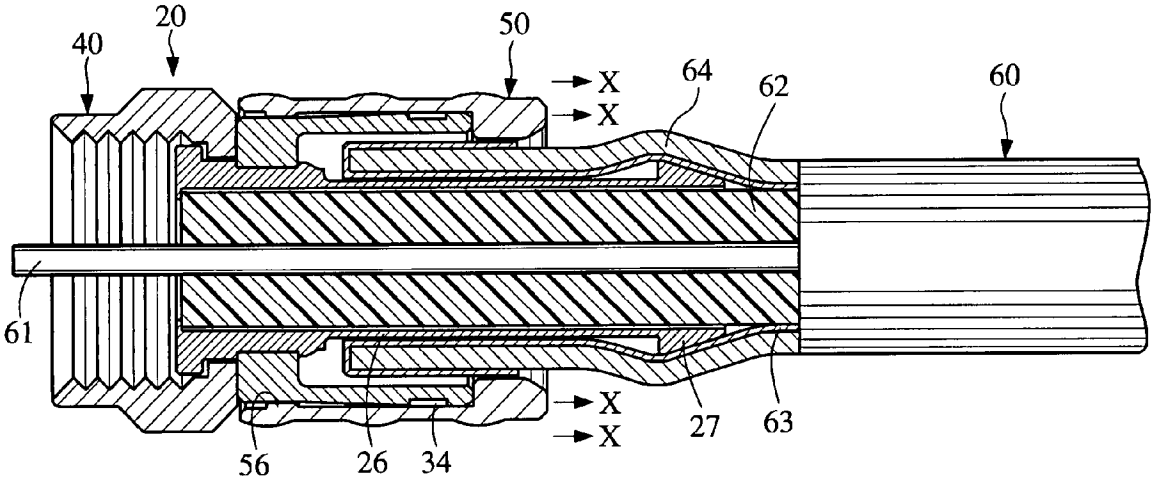
Figure 6C:
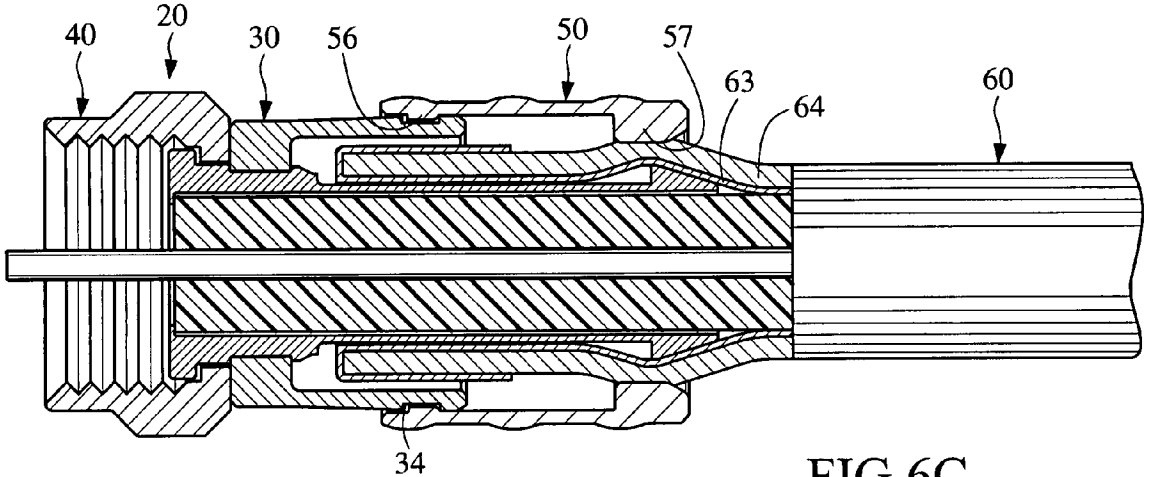

FIGS. 6A-6C show the installation of the tool-free coaxial connector of the present invention to the coaxial cable 60. Prior to the installation, it is necessary to remove a part of the sheath 64 at a free end of the cable 60 and fold back the outer conductor 63 so as to expose the insulating spacer 62 and the central conductor 61. At this time, the annular rib 56 of the slide collar 50 is positioned at the front end of the outer sleeve 30 and the arrowhead-shaped section 27 of the inner sleeve 21 is not yet enclosed in the inner flange 57 of the slide collar 50 as shown in FIG. 6A. After the free end of the cable 60 is prepared, the free end of the cable 60 is inserted into the connector main body 20 until the insulating spacer 62 contacts the inner flange 23 of the inner sleeve 21 as shown in FIG. 6B. When inserted, the tubular protruding end section 26 of the inner sleeve 21 is forcedly wedged between the insulating spacer 62 and the outer conductor 63 of the cable 60. In this case, a portion of the outer conductor 63 in contact with the arrowhead-shaped section 27 is expanded.

Then, a force in "X" direction is applied to the slide collar 50 to completely connect the cable 60 to the connector as shown in FIG. 6C. The slide collar 50 is pulled to move the annular rib 56 from the front end of the outer sleeve 30 to the rear end of the outer sleeve 30. Eventually, the annular rib 56 will enter the annular groove 34 with the inner flange 57 tightly binding an outer surface of the sheath 64. Under such circumstance, the slide collar 50 is securely mechanically connected to the cable 60 to keep the cable 60 in the connector.

In conclusion, with the above arrangements, the tool-free coaxial connector of the present invention can be installed on a coaxial cable without using any tool. By means of pulling the slide collar, which exerts sufficient compression force on the sheath of the coaxial cable, the coaxial cable can be securely connected to the connector.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A tool-free coaxial connector for mechanically and electrically connecting a coaxial cable to a device, the coaxial cable including a central conductor, an insulating spacer wrapping the central conductor, an outer conductor located around the insulating spacer, and a sheath coated on the outer conductor; the tool-free coaxial connector comprising:

an inner sleeve and an outer sleeve, the inner and outer sleeves being coaxially assembled to each other for accommodating the coaxial cable therein, such that the central conductor and the insulating spacer of the coaxial cable are received in the inner sleeve while the outer conductor and the sheath of the coaxial cable are positioned between the inner and outer sleeves; and a slide collar slidably connected to the outer sleeve, the slide collar including a tubular main body having a first end and a second end, the second end of the tubular main body being formed with an inner flange, whereby by pulling the slide collar to a predetermined position, the inner flange of the slide collar can tightly bind the sheath of the cable to securely connect the slide collar to the cable.

2. The tool-free coaxial connector as claimed in claim 1, wherein an arrowhead-shaped section is formed on an outer circumference of a rear end of the inner sleeve, whereby when the slide collar is moved to the predetermined position, the arrowhead-shaped section is enclosed in the inner flange of the slide collar.

3. The tool-free coaxial connector as claimed in claim 1, wherein anti-slip structures are formed on an outer circumference of the tubular main body.

4. The tool-free coaxial connector as claimed in claim 3, wherein the anti-slip structures are annular protrusions.

5. The tool-free coaxial connector as claimed in claim 1, wherein a locating structure is formed on an inner circumference of the tubular main body near the first end thereof and an annular groove is formed on an outer circumference of the outer sleeve near a rear end thereof, whereby when the slide collar is axially moved along the outer sleeve, the locating structure of the slide collar will enter the annular groove of the outer sleeve to fix the slide collar thereon.

6. The tool-free coaxial connector as claimed in claim 5, wherein the locating structure is an annular rib or a protrusion.

* * * * *